United States Patent [19]

Gieson et al.

[11] Patent Number: 4,462,585

[45] Date of Patent: Jul. 31, 1984

[54] THICKNESS ADJUSTABLE MATERIAL DETECTOR FOR GRIPPER MECHANISM

[75] Inventors: Clarence L. Gieson, Proctor; Randy J. Marsh; Reginald F. J. Lunt, both of Rutland, all of Vt.

[73] Assignee: Metromail Corporation, Rutland, Vt.

[21] Appl. No.: 365,970

[22] Filed: Apr. 6, 1982

[51] Int. Cl.[3] ..... B65H 5/10; B65H 7/12

[52] U.S. Cl. ..... 271/11; 271/263; 271/268

[58] Field of Search ..... 271/11, 14, 268, 263, 271/262, 5

[56] References Cited

U.S. PATENT DOCUMENTS

| | | | |
|---|---|---|---|
| 3,744,787 | 7/1973 | Morrison | 271/263 X |
| 3,885,780 | 5/1975 | Morrison | 271/263 X |
| 3,993,303 | 11/1976 | Riedl | 271/263 |
| 4,013,283 | 3/1977 | Tress | 271/263 X |

*Primary Examiner*—Richard A. Schacher

*Attorney, Agent, or Firm*—Harvey B. Jacobson

[57] ABSTRACT

The spacing between jaws on a gripper lever is gauged by a sensing rod movably mounted on the lever to actuate a limit switch supported in a switch housing clamped to the oscillatory shaft to which the gripper lever is attached. The limit switch is adjusted to detect deviations from the thickness of a single sheet of material clamped between the jaws during transfer from a magazine to a collating conveyor.

11 Claims, 7 Drawing Figures

THICKNESS ADJUSTABLE MATERIAL DETECTOR FOR GRIPPER MECHANISM

BACKGROUND OF THE INVENTION

This invention relates to material thickness detection reflecting malfunction of a sheet transfer operation in a "Phillipsburg Inserter" type of sheet material handling machine.

In a "Phillipsburg Inserter", sheet material stored in magazines at spaced stations along a collating conveyor, are withdrawn one at a time from the bottom of stacks by the jaws of a gripper mechanism at each station and dropped onto the conveyor. A detection system is provided at each magazine station to interrupt operation when malfunction occurs because of the withdrawal of multiple sheets or no sheet during any single operational cycle. Such detection system are disclosed, for example, in U.S. Pat. No. 3,371,331 to Buckholz and U.S. Pat. Nos. 3,744,787 and 3,885,790 to Morrison.

Detection systems in the foregoing prior art installations involve synchronized sensing of the sheet material by separate contact feelers at each magazine station or by a sensing switch operator connected to the gripper jaw pivot carried by the oscillatable lever of the gripper mechanism. Such detection facilities because of space requirements are relatively inaccessible for repair and maintenance purposes and often introduce an additional source of malfunction such as jamming during the sheet transfer operation. Thus, according to the Buckholz patent aforementioned, the sheet material is contacted by a movably mounted roller to sense material thickness. Such contact roller arrangements because of wear and dust accumulations are not always reliable and are difficult to install or replace. The jaw pivot mounting arrangement for the detector according to the the Morrison patents, suffer from the same drawbacks and are furthermore difficult to visually monitor and service.

It is therefore an important object of the present invention to provide a detection system for magazine stations at which sheets are transferred to a collating conveyor by a sheet gripping mechanism, avoiding the drawbacks of prior detection systems in such installations. A further object is to provide a detection system that is easier to install, maintain and replace and which is more reliable in operation as compared to prior art detection systems in such installations.

SUMMARY OF THE INVENTION

In accordance with the present invention, the spacing between the jaws of the gripper mechanism is gauged by a sensing rod mounted on the gripper lever itself to detect the thickness of the sheet material clamped between said jaws while being withdrawn from a magazine. A limit switch actuated by such sensing rod is supported remote from the jaws and in fixed relation to the gripper lever by a housing clamped to the oscillatory shaft to which the gripper lever is secured. Such switch mounting provides easy access for adjustment purposes and minimizes movement of switch parts during shaft motion. Further, sheet material detection is achieved by sensing movement of the existing jaws of the sheet gripping mechanism to avoid mounting of separate and independent sheet sensing facilities.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
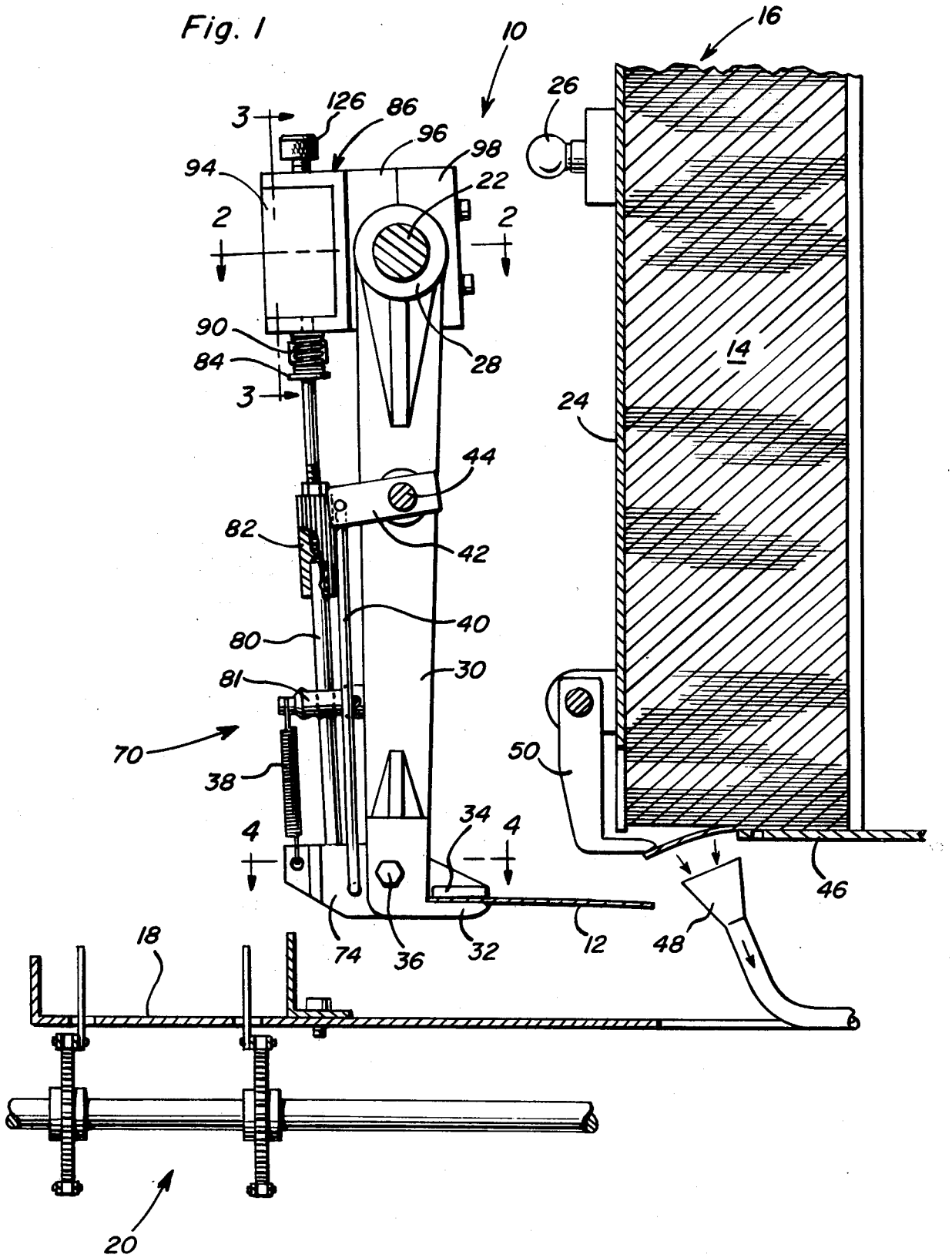
FIG. 1 is a side sectional view through a sheet collating machine at one of its magazine stations, showing the associated sheet transfer mechanism and detection system of the present invention.

Referring now to the drawings in details, FIG. 1 illustrates a sheet transfer mechanism 10 in a "Phillipsburg" type of inserter or collator. In this type of installation, the mechanism 10 functions during each operational cycle to withdraw a single bottom sheet from a stack 14, supported within a magazine 16, and deposit such sheet onto the horizontal surface of a slotted table 18 associated with a collating conveyor 20. The mechanism includes an oscillating shaft 22 mounted in fixed parallel spaced relation to the front wall 24 of the magazine on which a malfunction indicating lamp 26 may be mounted. Fixed to the shaft 22 is the hub 28 of a downwardly extending gripper lever 30 having a fixed jaw 32 projecting from its lower end toward the magazine. A movable jaw 34 is mounted on the gripper lever by a pivot 36 and is biased toward a gripping position by a spring 28. The movable jaw is connected by an actuating link 40 and lever arm 42 to an actuating shaft 44 by means of which the jaw 34 is opened to receive a bottom sheet from stack 14 on the fixed jaw 32 before the bottom sheet is clamped thereto by closing of the movable jaw to the gripping position shown in FIG. 1. The jaw 34 is therefore opened by the actuating shaft 44 in proper timed relation to arrival of the gripper lever at one end of the oscillatory stroke. At such end of the gripper stroke, the fixed jaw 32 underlies the bottom sheet, deflected downwardly from bottom support 46 by a suction cup device 48 and held deflected by pivoted finger 50 as shown. The deflected bottom sheet is then clamped to the fixed jaw 32 by closing of the movable jaw 34 before the gripper lever begins movement toward the other end of the oscillatory stroke. The bottom sheet is thereby withdrawn from the magazine and carried toward conveyor 20 as shown in FIG. 1. Approaching the other end of the stroke of the gripper lever, the movable jaw is opened so that the withdrawn sheet is dropped onto the conveyor 20. The transferred sheets travel on the conveyor to the next collating station of the "Phillipsburg" machine or to an inserting station. Sheet transfer mechanisms are associated with each collating station in order to assemble or collate a plurality of sheets for insertion into envelopes at the inserting stations in accordance with apparatus well known in the art.

Generally, some sheet detection system is provided in the foregoing installation, as disclosed, for example, in U.S. Pat. No. 3,371,331 to Buckholz aforementioned. The detection system in all cases senses the bottom sheets being withdrawn during an appropriate phase of each operational cycle determined by a switch operating cam 52 as diagrammed in FIG. 7. A relay coil 54 is energized by voltage source 56 in the event multiple or no sheets are withdrawn from the magazine. When energized, the relay coil 54 closes relay holding switch 58 and actuates the relay switches 60 and 62 to disconnect the machine operating motor 64 from its power lines 66 and 68. The power lines are at the same time connected across the malfunction indicator 26 through the actuated relay switches 60 and 62. Thus, operation of the machine is interrupted whenever improper sheet transfer is detected and indicator lamp 26 illuminated to alert the machine operator of such malfunction. In accordance with the present invention, the mechanism 10 is associated in a unique manner with a novel sheet detection device generally referred to by reference numeral 70.

Figure 3:
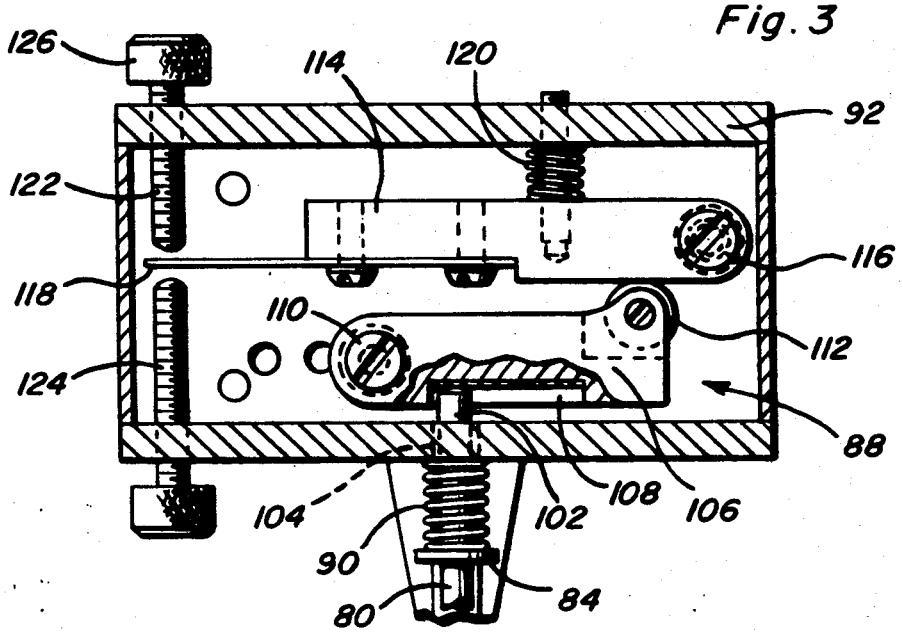
FIG. 3 is an enlarged sectional view taken substantially through a plane indicated by section line 3—3 in FIG. 1.
Figure 4:
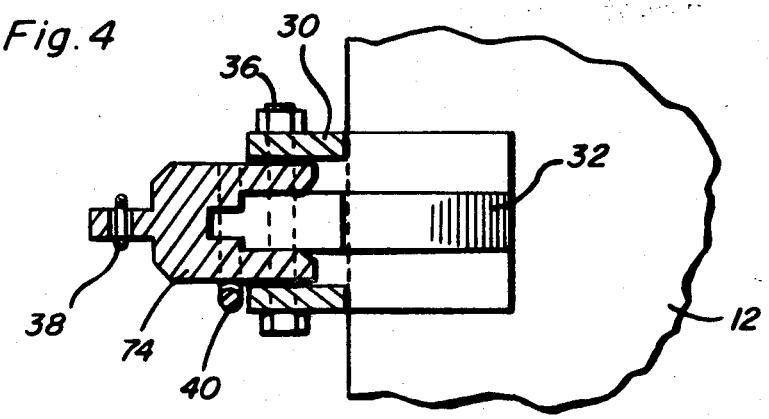
FIG. 4 is an enlarged sectional view taken substantially through a plane indicated by section line 4—4 in FIG. 1.
Figure 5:
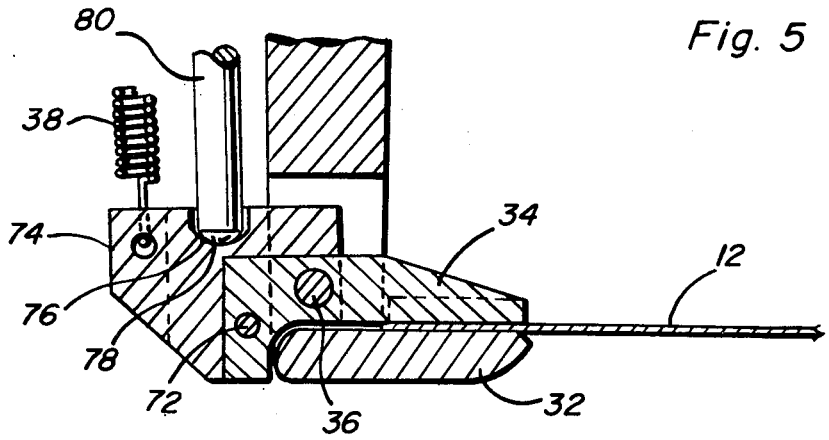
FIG. 5 is a sectional view taken substantially through a plane indicated by section line 5—5 in FIG. 4.

The sheet detection device 70 senses the thickness of any material clamped between the jaws 32 and 34 by directly gauging the spacing or lack of spacing between the confronting gripping surfaces of the jaws which hold the material being withdrawn from the magazine. Toward that end, the movable jaw 36 is secured by the lower end 72 of link 40 to a body 74 as more clearly seen in FIGS. 4 and 5. The body 74 is connected to the lower end of spring 38 and is formed with a socket recess 76 within which the lower end 78 of sensing rod 80 is received. The rod 80 is formed from two sections that are longitudinally spaced by an adjustable amount through a coupler 82. The lower section of rod 80 extends through a support 81 fixed to the gripper lever and to which spring 38 is anchored. The upper section of rod 80 has disc 84 fixed thereto in spaced relation to the housing 86 of a limit switch device 88 into which the rod projects. As shown in FIGS. 1 and 3, a spring 90 mounted on the rod 80 between the disc 84 and switch housing 86 biases the rod downwardly so as to hold its lower end 78 in engagement with the body 74 to which the movable jaw is secured.

Figure 2:
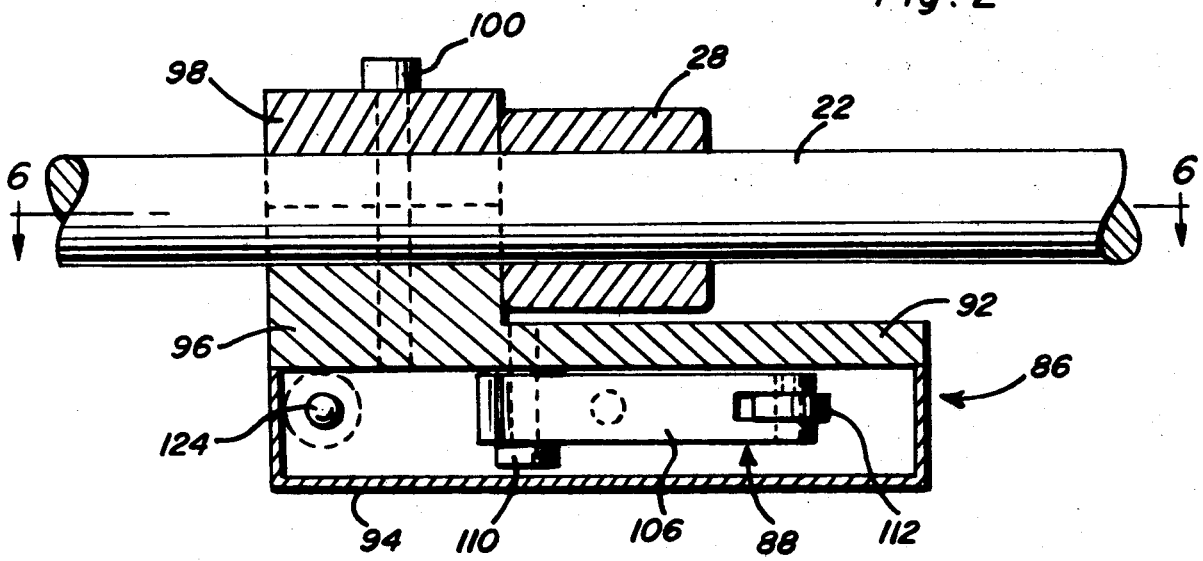
FIG. 2 is an enlarged sectional view taken substantially through a plane indicated by section line 2—2 in FIG. 1.
Figure 6:
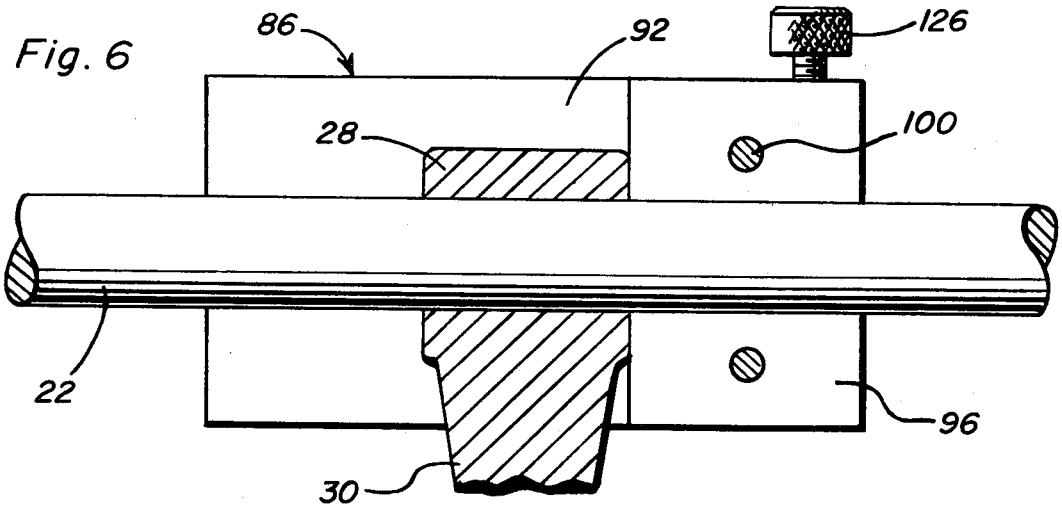
FIG. 6 is a sectional view taken substantially through a plane indicated by section line 6—6 in FIG. 2.

The limit switch device 88 is supported by the housing 86 adjacent to the oscillatory shaft 22 in fixed relation to the gripper lever 30. As more clearly seen in FIGS. 2, 3, and 6, the housing 86 has a channel-shaped body 92 to which a cover 94 is removably secured for enclosing the limit switch device. A shaft-mounting formation 96 projects from the housing body 92 into abutment with the shaft 22 and the hub 28 of the gripper lever. A clamp member 98 secured by fasteners 100 to the formation 96 securely fixes the switch body 92 to the shaft 22 for oscillation with the gripper lever. Thus, the entire sheet detection device 70 is movable with the gripper lever to sense movement of the movable jaw 34 relative thereto, while the limit switch device 88 is supported as close as possible to the shaft 22 in order to minimize linear movement of the switch parts.

Figure 7:
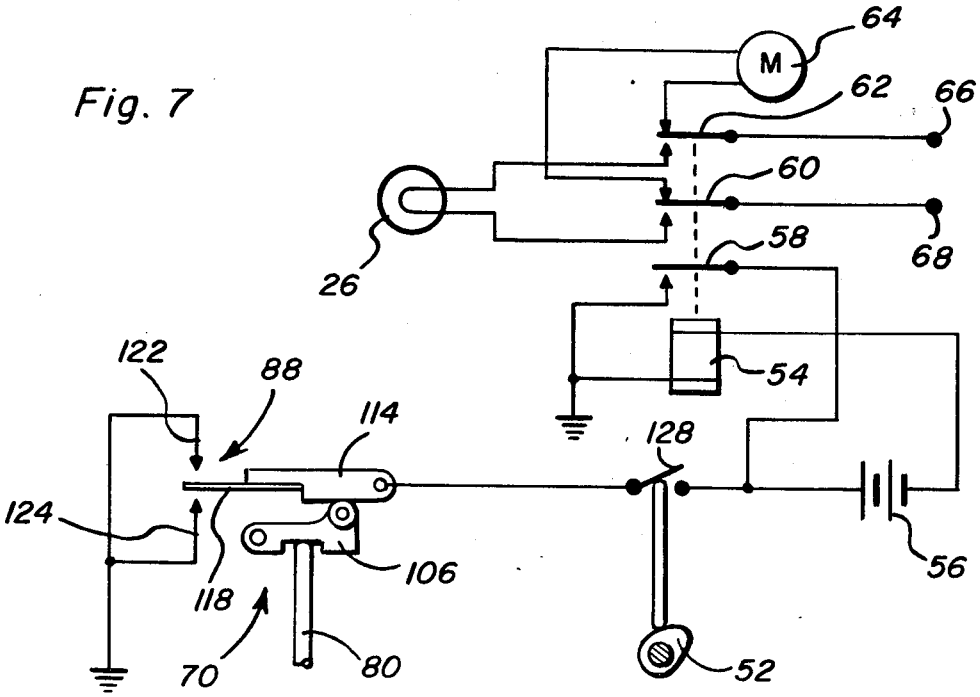
FIG. 7 is a simplified electrical circuit diagram illustrating the controls associated with the detection system of the present invention.

As more clearly seen in FIG. 3, the upper end 102 of the motion sensing rod 80 projects into the switch housing body 92 through a guide opening 104 to engage a switch operating lever 106 within a recess 108 therein. The operating lever is mounted on the housing body by pivot 110 at an end opposite roller 112 through which a displacing force is applied to a switch arm 114 mounted on the body 92 at one end by pivot 116. A contactor blade 118 is secured to and extends from the other end of switch arm 114 biased into engagement with roller 112 by spring 120. The switch blade is thereby positioned by rod 80 between adjustably spaced contact elements 122 and 124 fixedly mounted on the housing body 92. Adjustment knobs 126 connected to the external ends of the contact elements enable one to adjust the spacing of the contact elements to establish the desired limit positions to which the switch blade 118 is displaced, respectively representing the detection of no sheet or multiple sheets clamped between the jaws 32 ad 34. As shown in FIG. 7, in either of the limit positions of the switch device 88 a circuit is completed to energize relay coil 54 upon closing of switch 128 by cam 52 in order to interrupt operations by deenergizing motor 64 and providing an alert through indicator 26. However, when the sensing rod 80 gauges proper spacing between jaws 32 and 34 during the sheet withdrawal phase of an operational cycle, reflected by closing of cam switch 128, the switch blade 118 will assume a position spaced from both contacts 122 and 124 as shown in FIGS. 3 and 7 to hold the relay energizing circuit open.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a mechanism for transferring a single sheet from a magazine to a conveyor during each operational cycle, said mechanism having an oscillatable shaft, a gripper lever fixed to the shaft, a movable jaw pivot means mounting the movable jaw on the lever in spaced relation to the shaft, actuating means connected to the movable jaw for opening and closing thereof to clamp sheets to the gripper lever and detecting means for interrupting operation of the transferring mechanism in response to withdrawal of none or more than one of the sheets from the magazine during any one of the operational cycles, the improvement including motion sensing means mounted on the lever in spaced relation to the pivot means and in engagement with the movable jaw for displacement relative to the lever in response to operation of the actuating means, and means mounting the detecting means on the shaft in fixed relation to the lever for detecting said displacement of the motion sensing means reflecting clamping of none or more than one of the sheets to the lever by the movable jaw.

2. The improvement as defined in claim 1 wherein said mounting means includes a housing, and means clamping the housing to a shaft in abutment with the gripper lever, said detecting means including a spring-biased switch arm pivotally mounted within the housing, a pair of contacts mounted within the housing for engagement by the switch arm, and a switch operating lever pivotally mounted within the housing in engagement with the switch arm and the motion sensing means.

3. The improvement as defined in claim 2 wherein said motion sensing means includes an elongated rod having opposite ends respectively engageable with the movable jaw and the switch operating lever, said housing having a guide opening through which the rod extends.

4. The improvement as defined in claim 1 wherein said motion sensing means includes an elongated rod having opposite ends respectively engageable with the movable jaw and the detecting means.

5. In combination with a mechanism for transferring a single sheet from a magazine to a conveyor during each operational cycle, said mechanism having an oscillatable shaft, a gripper lever fixed to the shaft, a movable jaw, pivot means mounting the movable jaw on the lever, and actuating means connected to the movable jaw for opening and closing thereof to clamp sheets to the gripper lever; the improvement comprising sensing means mounted on the gripper lever in spaced relation to the pivot means for displacement in response to movement of the movable jaw to a gripping position on the lever corresponding to the clamping of said single sheet during each of said operational cycles, and means mounted on the shaft remote from the pivot means in engagement with said sensing means for detecting deviation of the movable jaw from said gripping position.

6. The improvement as defined in claim 5 wherein said detecting means comprises a limit switch device actuated by the sensing means, a switch housing supporting the limit switch device and means mounting the switch housing on the shaft in fixed relation to the gripper lever.

7. The improvement as defined in claim 6 wherein the sensing means comprises a motion transmitting rod having opposite ends respectively engageable with the movable jaw and the limit switch device.

8. The improvement as defined in claim 5 wherein the sensing means comprises a motion transmitting rod having opposite ends respectively engageable with the movable jaw and the limit switch device.

9. In combination with a mechanism for withdrawing sheets of material from a magazine during operational cycles, said mechanism having an oscillatable shaft, a gripper lever fixed to the shaft, a pivot carried by the lever, a movable jaw mounted on the lever by the pivot, and actuating means connected to the movable jaw for opening and closing thereof to clamp sheets to the gripper lever; the improvement comprising sensing means mounted on the lever and engageable with the movable jaw for sensing movement thereof, and limit switch means mounted on the shaft in fixed relation to the lever remote from the pivot for engagement by the sensing means to detect deviation from the thickness of a single sheet of material clamped to the gripper lever by the jaw during withdrawal from the magazine.

10. The improvement as defined in claim 9 wherein said sensing means is a motion transmitting rod of adjustable length.

11. In combination with a gripper mechanism comprising a power shaft, a gripper arm having opposite ends, means mounting the gripper arm adjacent one of said ends on the power shaft for rotation in opposite directions to and from an insert pickup position, the other of the ends of the gripper arm forming one portion of a gripper jaw, a pivot rotatably mounted in said gripper arm adjacent to said other of the ends, a gripping jaw affixed to said pivot to form the other portion of said gripper jaw, a movable element displaceable between two extreme positions, a linking lever coacting with and controlling displacement of said movable element, and electrical detection means for detecting the position of said movable element, the improvement comprising housing means for fixedly mounting the movable element and the linking lever on the power shaft adjacent to said one of the ends of the gripper arm and sensing means mounted on the gripper arm in engagement with the gripping jaw and the linking lever for displacement of the movable element relative to the housing means between the two extreme positions causing the detection means to operate.

* * * * *